US007322418B2

(12) United States Patent
Ayling

(10) Patent No.: US 7,322,418 B2
(45) Date of Patent: Jan. 29, 2008

(54) CONTINUOUS CIRCULATION DRILLING METHOD

(75) Inventor: Laurence J. Ayling, Camberly (GB)

(73) Assignee: Coupler Developments Limited (IM)

( * ) Notice: Subject to any disclaimer, the term of this patent is extended or adjusted under 35 U.S.C. 154(b) by 0 days.

(21) Appl. No.: 10/780,796

(22) Filed: Feb. 18, 2004

(65) Prior Publication Data

US 2004/0159467 A1 Aug. 19, 2004

(51) Int. Cl.
*E21B 33/02* (2006.01)

(52) U.S. Cl. ..... 166/380; 166/81.1; 175/218

(58) Field of Classification Search ..... 166/380, 166/81.1; 175/218, 72, 207, 209, 215
See application file for complete search history.

(56) References Cited

U.S. PATENT DOCUMENTS

| | | | | |
|---|---|---|---|---|
| 2,245,960 | A * | 6/1941 | Guy | 173/180 |
| 3,559,739 | A * | 2/1971 | Hutchison | 166/311 |
| 4,315,553 | A * | 2/1982 | Stallings | 175/207 |
| 6,119,772 | A * | 9/2000 | Pruet | 166/81.1 |

* cited by examiner

*Primary Examiner*—Frank Tsay
(74) *Attorney, Agent, or Firm*—Bartlett & Sherer; Ronald B. Sherer

(57) ABSTRACT

A method for drilling wells in which the tubular can be added or removed from the drill string whilst mud and drilling fluids being circulated continuously and kept separated from the environment to reduce pollution. A connector is used with an inlet and outlet for the mud etc. and which incorporates rams to seal off and separate the flow of mud as a tubular is added or removed.

12 Claims, 7 Drawing Sheets

CONTINUOUS CIRCULATION DRILLING METHOD

The present invention relates to a method for drilling wells, particularly drilling for hydrocarbons.

In drilling wells for hydrocarbons, particularly petroleum, the drill string is rotated to drive the drill bit and mud is circulated to cool, lubricate and remove the rock cuttings formed by the drilling.

As the drill penetrates into the earth, more tubular drill stems are added to the drill string. This involves stopping the drilling whilst the tubulars are added. The process is reversed when the drill string is removed; e.g. to replace the drilling bit. This interruption of drilling conventionally means that the circulation of the mud stops and has to be re-started on recommencement of the drilling which, as well as being time consuming, can also lead to deleterious effects on the walls of the well being drilled and can lead to problems in keeping the well 'open'.

Additionally the mud weight is conventionally chosen to provide a static head relating to the ambient pressure at the top of the drill string when it is open while tubulars are being added or removed. This weighting of the mud can be very expensive.

We have now invented a method and equipment for drilling wells in which the tubular members forming part of the drill string can be added or removed during continuous circulation of mud in a closed system such that relating the mud weight to the static head below the drilling head is no longer necessary.

According to the invention there is provided a method for drilling wells in which a drill bit is rotated at the end of a drill string comprising tubular members joined together and mud is circulated through the tubular drill string, in which method tubular members are added to or removed from the drill string whilst the circulation of mud continues.

The method enables there to be continuous rotation of the drill string while tubulars are added or removed and for there to be continuous vertical motion of the drill string by addition or removal of tubulars.

The method provides for the supplying of mud, at the appropriate pressure in the immediate vicinity of the tubular connection that is about to be broken such that the flow of mud so provided overlaps with flow of mud from the top drive, as the tubular separates from the drill string. The separated tubular is then totally separated from the drill string by the closure of a blind ram or other preventer or other closing device such as a gate valve. The separated tubular can then be flushed out e.g. with air or water (if under water) depressured, withdrawn, disconnected from the top drive and removed. The action of the said blind ram is to divide the pressure chamber into two parts such that the separated tubular may be removed from the upper depressurised part without loss of mud to the environment the drill string continues to be circulated with mud at the required pressure from the lower part of the chamber.

Preferably there are means which seal off the circulating mud and other fluids to prevent environmental contamination whilst they are still circulating.

In a preferred embodiment of the invention a tubular can be added using a clamping means which comprises a 'coupler' and the top end of the drill string is enclosed in and gripped by the lower section of the coupler, in which coupler there is a blind preventer which separates the upper and lower sections of the coupler, the tubular is then added to the upper section of the coupler and is sealed by an annular preventer and the blind preventer is then opened and the lower end of the tubular and upper end of the drill string joined together.

In use, the lower section of the coupler below the blind preventer will already enclose the upper end of the drill string before the tubular is lowered and when the tubular is lowered into the coupler the upper section of the coupler above the blind preventer will enclose the lower end of the tubular.

The tubular can be added to the drill string by attaching the lower section of the coupler to the top of the rotating drill string with the blind preventer in the closed position preventing escape of mud or drilling fluid. The tubular is lowered from substantially vertically above into the upper section of the coupler and the rotating tubular is then sealed in by a seal so that all the drilling fluid is contained, the blind preventer is then opened and the tubular and the drill string brought into contact and joined together with the grips bringing the tubular and drill string to the correct torque.

The lower end of the tubular and the upper end of the drill string are separated by the blind preventer such that the tubular can be sealed in by an upper annular preventer so that when the blind preventer is opened there is substantially no escape of mud or drilling fluid and the tubular stand and drill string can then be brought together and made up to the required torque.

To remove another tubular from the drill string the tubular spool or saver sub under the top drive penetrates the upper part of the pressure chamber, is flushed out with mud and pressured up; the blind ram opens allowing the top drive to provide circulating mud and the spool to connect to and to torque up the into the drill string. The pressure vessel can then be depressured, flushed with air (or water if under water) and the drill string raised until the next join is within the pressure chamber, the 'slips and grips' ram closed, the pressure chamber flushed with mud and pressured up and the cycle repeated thus avoiding pollution of the environment, either above or below the water.

Preferably the coupler includes slips which support the drill string while the top drive is raised up to accept and connect another driver.

The method can be used in drilling in which a drill string is rotated from a top drive rotating means and drilling fluid is circulated down the drill string in the conventional way.

The making and breaking of joints can be carried out using conventional rotating grips which can be outside the coupler but preferably are within the coupler.

As the mud, drilling fluids or other circulating fluids can be kept segregated from the environment there is the capacity to reduce pollution and this is particularly advantageous subsea where it reduces the risk of contamination of the sea-water particularly with oil based muds which will not be able to enter the marine environment. Additionally water may be excluded from the mud where well bores could be damaged by water.

The pressure isolation means that the mud weighting is not based on the 'static head' as in conventional drilling, but is based on the pressure profile required over the exposed formation of the borehole, and is determined by the mud inlet and return pressures, the characteristics of the exposed formation and the properties of the returning mud, and so expensive weighting additives which can be required to be added to the mud in conventional drilling to provide adequate weight of mud need not be used except for emergency kill stocks.

This makes it much easier to 'hold the hole open' and allows for the choice of lighter drilling muds which can result in considerable savings in costs over conventional drilling methods.

The method of the invention enables a steady and controllable pressure to be maintained on the exposed formation wall down the borehole at all times from first drilling until cementing the casing and this can be achieved in overbalanced, balanced or underbalanced drilling. This enables the ROP to be safely maximised and formation damaged to be minimised. The method of the invention is particularly valuable for use in underbalanced drilling where its true benefits can be achieved by controlling the downhole pressure to any desired value between losing circulation and well bore collapse which can maximise the rate of penetration. The downhole pressure can be easily and immediately altered without changing the mud weight while tubulars are added and removed and is therefore much safer to use when 'kicks' occur.

The method of the invention can be remotely controlled e.g. by computer assisted control with manual override etc. which makes the method especially suitable for application in hostile areas such as underwater in deep water, under ice etc.

It is also a feature of the invention that the circulation fluids and the immediate environment are very well segregated from each other, such that the rig could operate subsea without contamination of the sea with drilling mud or contamination of the drilling mud with sea water.

A suitable modified Blow Out preventer (BOP) stack can comprise, from the top downwards:

(i) An upper annular RBOP which withstands the inlet mud pressure but in use will not pass a tubular joint (box or upset) and so can easily be changed out (ii) A chamber divider which divides the pressure chamber in the coupler and can be a blind BOP (Ram or rotary) which can withstand the inlet mud pressure and has a flushing outlet.

(iii) An annular ram BOP, which has a profile adapted to perform the function of 'slips' and 'gripping' the lower box for torquing and untorquing of the drill string with mud inlet (iv) A lower annular RBOP which contains the annular mud return mud and (v) One or more pipe or shear ram safety BOPs and a diverter if required.

In equipment for carrying out the invention a rotary blow out preventer (RBOP), which is a well known and commercially available piece of equipment can be used to seal off the annulus between the drill string and the casing and contains the returning mud under appropriate pressure control as is currently carried out in underbalanced drilling. However current RBOPs have to seal under significant differential pressure across the seal and the seals have to be replaced frequently and so adversely affects the drilling. In the method of the invention all the functions can be incorporated into a single modified BOP stack and the RBOP which seals the annulus is 'wet' on both sides. This enables the sealing force to be greatly reduced with consequent much longer life for the seals. The main differential pressure can be taken by a second RBOP which is above the tubular connection level and so can be easily changed out, even in the middle of drilling a well.

This BOP stack replaces the rotary table and slips in conventional BOPs and can be reduced in height by, for example, using a double RBOP for (i) and (ii) and a double ram BOP for (iv) and (v).

When not drilling the mud is only needed to hold back the exposed formation wall and when tripping the circulation can be stopped as soon as the bit is above the last casing shoe, but the mud make-up for lost circulation and drill pipe displacement can continue to be supplied below lowest BOP or diverter. When casing is to be applied down the hole the 'drilling coupler' can be removed and the casing can be similarly be introduced through a large diameter/low pressure modified 'Casing coupler' so that the appropriate pressure can be kept on the exposed formation at all times until the casing is in place and cemented.

Potential blow out situations due to 'open hole' conditions are eliminated and pressure control is more continuous and consistent and blow out prevention is improved since the downhole pressure may be immediately raised and maintained while tubulars are added to or removed from the drill string.

In use, in overbalanced drilling the mud weight is calculated to give the appropriate pressure gradient across the exposed formation and the pressure chosen is calculated to provide the optimum fluid migration rate into the least stable horizon of the exposed formation, without causing formation damage, to hold back the hole wall, in overbalanced drilling formation damage and lost circulation are less likely due to the continuous and steady static and dynamic pressures applied by a continuously closed inlet and system and by continuous mud circulation.

In the case of underbalanced drilling the gradient is set to provide a margin above the pressure at which the bore hole collapse might occur at all levels of the exposed formation wall and formation damage and well bore collapse are also less likely due to the continuous and steady static and dynamic pressures applied by a continuously closed inlet and system and by continuous mud circulation. In cases where the formation is loose this less expensive tight drilling fluid can be lost to the formation without excessive cost instead of having to stabilise it, provided the formation is not easily blinded and damaged by the cutting fines.

With the segregation of the mud from the environment oil based muds can be used and so water can be eliminated where sensitive exposed formations may be damaged by water.

In the case of a significant 'kick', the control of inlet and outlet pressures and the ability to 'circulate in' heavier muds will make it easier to clear a kick from a well and, if the drill string is significantly out of the hole it can be re-introduced while circulating continuously at the pressure required.

The method of the invention can be carried out with the continuous rotation of the drill and circulation of the mud and drilling fluid. Mud can thus pass into the drill string from inside the coupler which can then overlap and mix with the passage of mud down the tubular stand from the top drive.

There is the ability to continue rotation of the drill string and to continue circulation of the mud or other drilling fluids without interruption throughout drilling operations.

The rotation of the drill string is thought to set up an almost stable regime within the exposed formation such that stopping rotation can have adverse effects and the method of the present invention enables continuous rotation to take place.

The controlled pressure drilling which can be achieved by the method of the invention means that the added continuous rotation will benefit drilling by maintaining a steady and uninterrupted treatment of the well bore with a substantially constant pressure and hydro-mechanical regime stabilised by continuous rotation of the drill stem without interruption.

The continuous rotation will reduce the occurrence of sticking of the drill bits and bit assemblies, which are prone to occur when rotation is stopped. To accomplish this the coupler can be modified to provide a motorised 'slips and grips' such as providing a drive to the internal rotary mechanism of an RBOP so that the drill string can be kept rotating when disconnected from the top drive. The rotation of the top drive and the RBOP could operate differentially to achieve the making and breaking and torquing and untorquing of tubular joints while the drill string continues to rotate in the hole. This can also be used in turbine drilling where the rotary 'slips and grip' keep the drill string slowly rotating while the top drive is disconnected.

As shown in FIG. 2 (described later) an additional motorised rotary grips is included in the coupler so that both boxes to be connected are gripped. By gripping both halves of the connection the link between the two ripping locations is shortened which simplifies the differential rotation and torquing.

When the drill string is being added to a well, preferably there is a superstructure above the ground which is able to support the next tubular member above and substantially on the axis of the hole being drilled. The tubular member is supported above and substantially on the axis of the drill string. Thus slant drilling with this method is practical.

In order to add or remove a tubular a first handler, which incorporates a clamping means, is attached to the upper end of the tubular to be added and rotates this tubular to the desired speed of rotation. A second handler, incorporating a clamping means, is already clamped around the top of the drill string which it is supporting, rotating and circulating. It accepts the entry from above of the lower end of the new tubular hanging from the first handler. The second handler effects the connection and the second handler is then detached and the weight of the drill string taken by the first handler. The first handler then moves downwards as the drill string moves down the well being drilled. The second handler then moves upwards so that it can clamp around the top end of the next tubular to be added to the drill string.

The clamping means preferably comprises clamps which comprise substantially two semi-circular clamps which can be positioned at either side of a tubular and driven inwards, e.g. hydraulically until their ends meet and the tubular is firmly clamped and the connection between the tubulars completely enclosed.

As the invention enables the circulation of mud or other fluids to continue at all times whilst coupling or uncoupling tubulars the drill sting can be inserted into or withdrawn from the well in a continuous steady motion at all times, even whilst coupling in uncoupling tubulars and that during tripping out of or into the hole there need be no interruption to the steady and continuous axial movement of the drill string or to its rotation or to its circulation. Thereby, not only is drilling and tripping more continuous and efficient but, the hydraulic treatment of the exposed wall of the hole is very much preferred.

This process can then be repeated with the first and second handlers changing positions sequentially in a "hand over hand" sequence so that the drill can penetrate into the ground continuously whilst drilling is in operation.

When it is desired to removed the drill string, the process is then reversed.

This can be accomplished by a process in which the first handler, which is gripping the end of the drill string and taking its weight, moves vertically upwards, raising the drill string whilst it is still rotating. When the drill string is lifted sufficiently so that the connection to the next tubular is above the ground, the second handler grips this connection taking the weight of the drill string. The connection between the tubulars is disengaged by the second handler and the first handler removes the disengaged tubular. The second handler continues to move upwards and the process is repeated.

Preferably each of the handlers are adapted to take the entire weight of the drill string, rotate the drill string, couple and uncouple the connection between the tubulars and circulate the mud and other fluids through the drill string.

The handlers can be mounted either side of the drill string and may be mounted on vertical supports so that they can be moved vertically or horizontally, as required.

Preferably the handlers are mounted on mechanical arms that can be moved vertically and horizontally by mechanical, hydraulic or electrical power such that no fixed structure is required above the base of the drilling rig. The mechanical arms by being mounted on the base of the drilling rig, transfer the significant weight of the drill string directly through to the rig's feet.

The method of the invention can be applied to two handlers or to three or more handlers working hand over hand. Additionally, stands of tubulars may be connected or disconnected in one or two or more joints at a time, according to the particular design configuration.

The top drive or upper hand which holds and rotates the drill string can be substantially similar to conventional top drives.

The method of the invention can be used to raise up a drill string and to remove tubulars by reversing the steps specified above. The tubulars can be placed or removed from position by using conventional handlers to move the tubulars sideways.

It is a feature of the invention that it enables the rotation of the drill string to continue at all times whilst connecting and disconnecting tubulars and that it enables the mud or drilling fluid to be continued at all times whilst coupling and uncoupling the tubulars.

The method can be used in all conditions e.g. onshore and subsea.

The design is intended for unmanned operation by remote computer assisted control or computerised control with remote manual override and is therefore particularly suitable for underwater operations and particularly applicable to deep sea, under ice and other hostile situations The invention is described with reference to the drawings in which.

Figure 1:
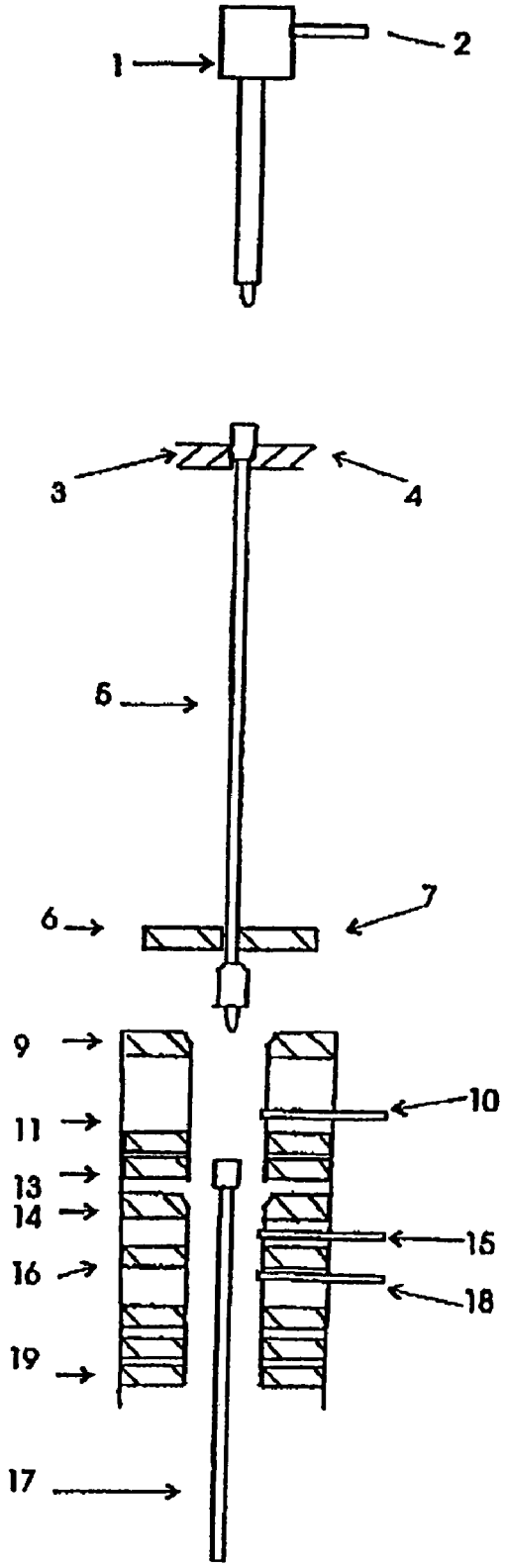
FIGS. 1, 2 and 3 show schematically a side view of couplers according to the invention
Figure 2:
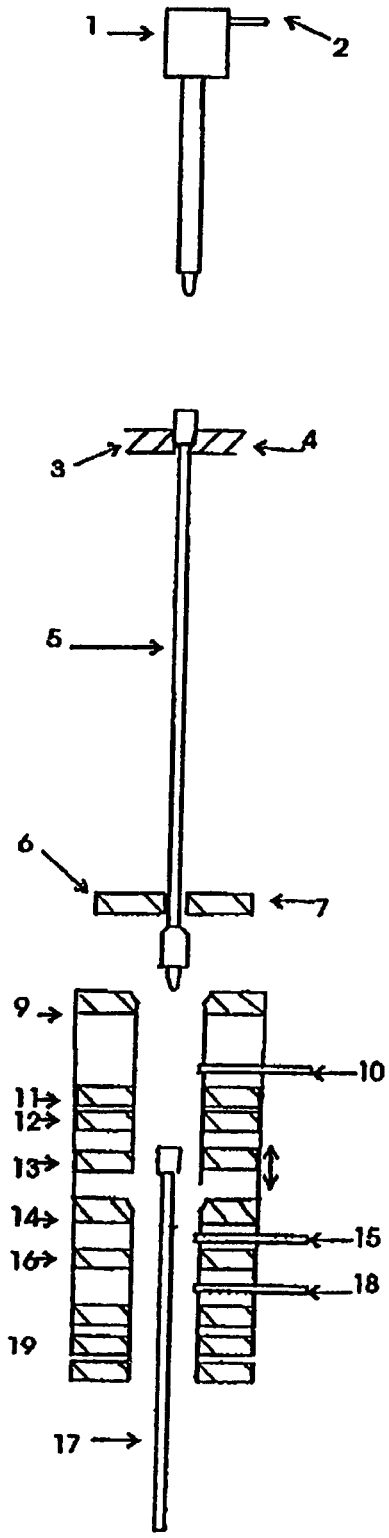
Figure 3:
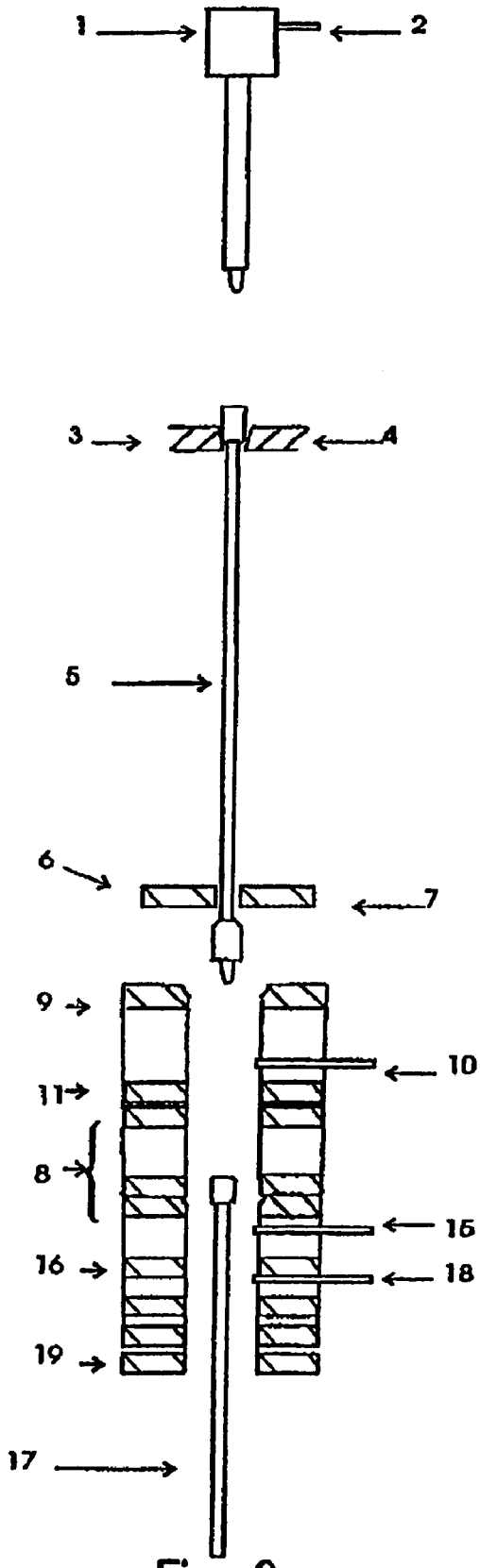

Referring to FIGS. 1, 2 and 3 a top drive (1) has a flushing inlet (2) and is adapted to connect to a tubular (5). Grips (4) can grip tubular (5) and form part of top handler (3), there is a bottom handler (6) and guide (7). The coupler comprises upper annular preventer (9), flushing outlet (10). There is a blind preventer (11) which can separate the upper and lower sections of coupler. There are upper grips (12) and lower grips (13) which are capable of gripping the tubular. There are slips (14) and flushing inlet (15) and the lower annular preventer (16). The lower grips (13) can grip the top of the drill string (17). In the embodiment of FIG. 3 there is a rotating BOP (19) and rotating slips and grips (8) as shown.

Figure 4:
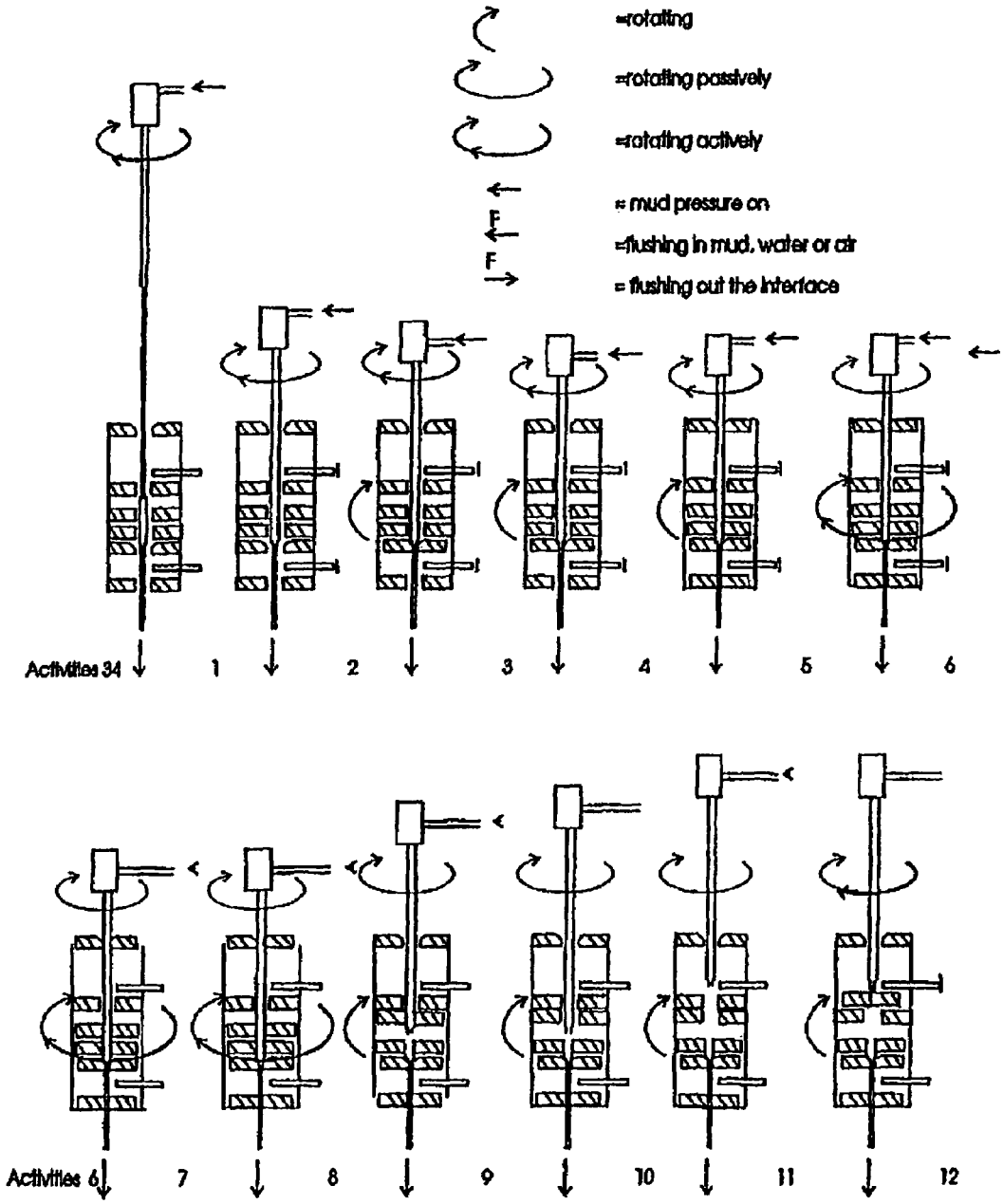
FIGS. 4, 5 and 6 show the sequence of an operation of an embodiment of the invention including continuous circulation and rotation such as illustrated in Table 1
Figure 5:
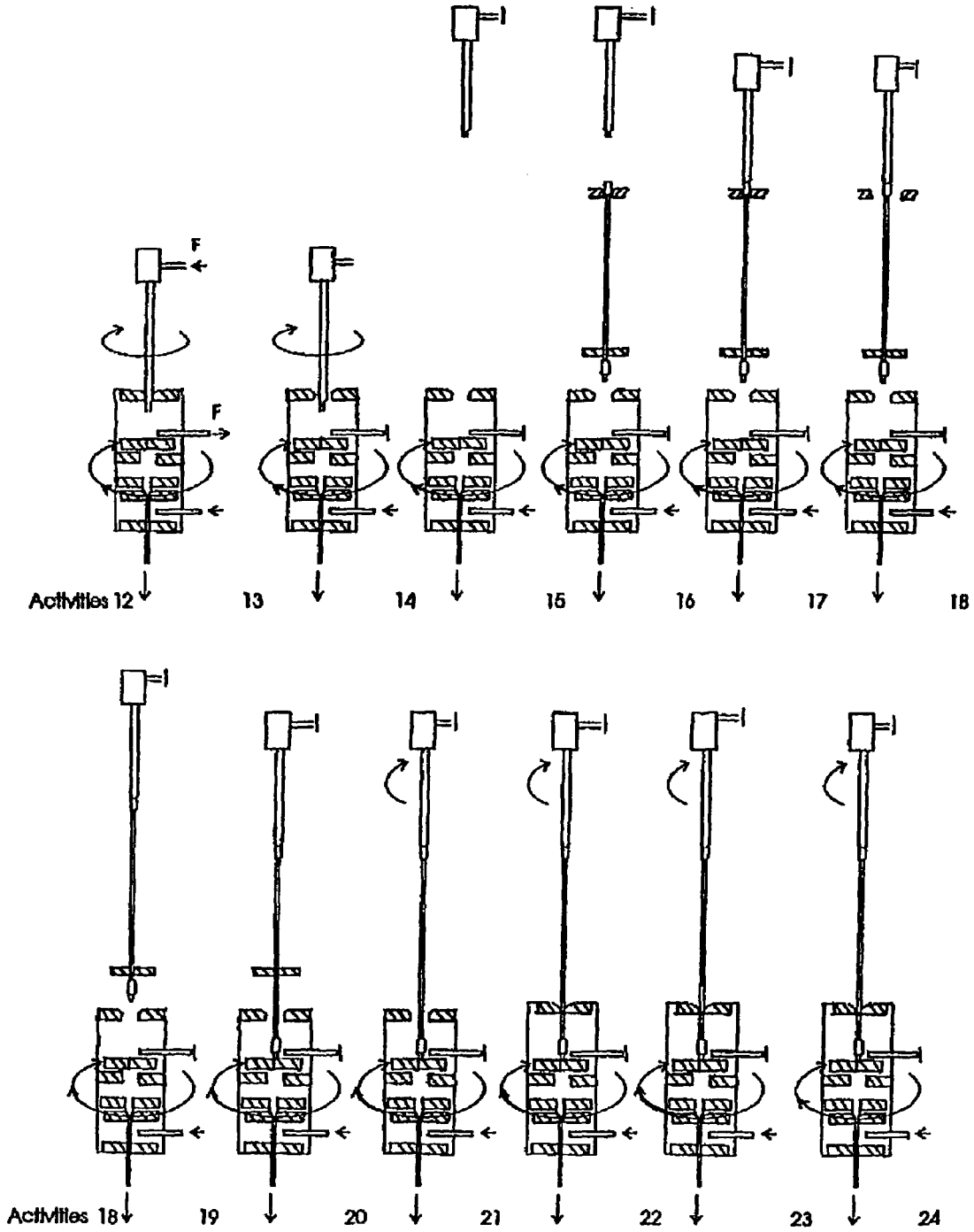
Figure 6:
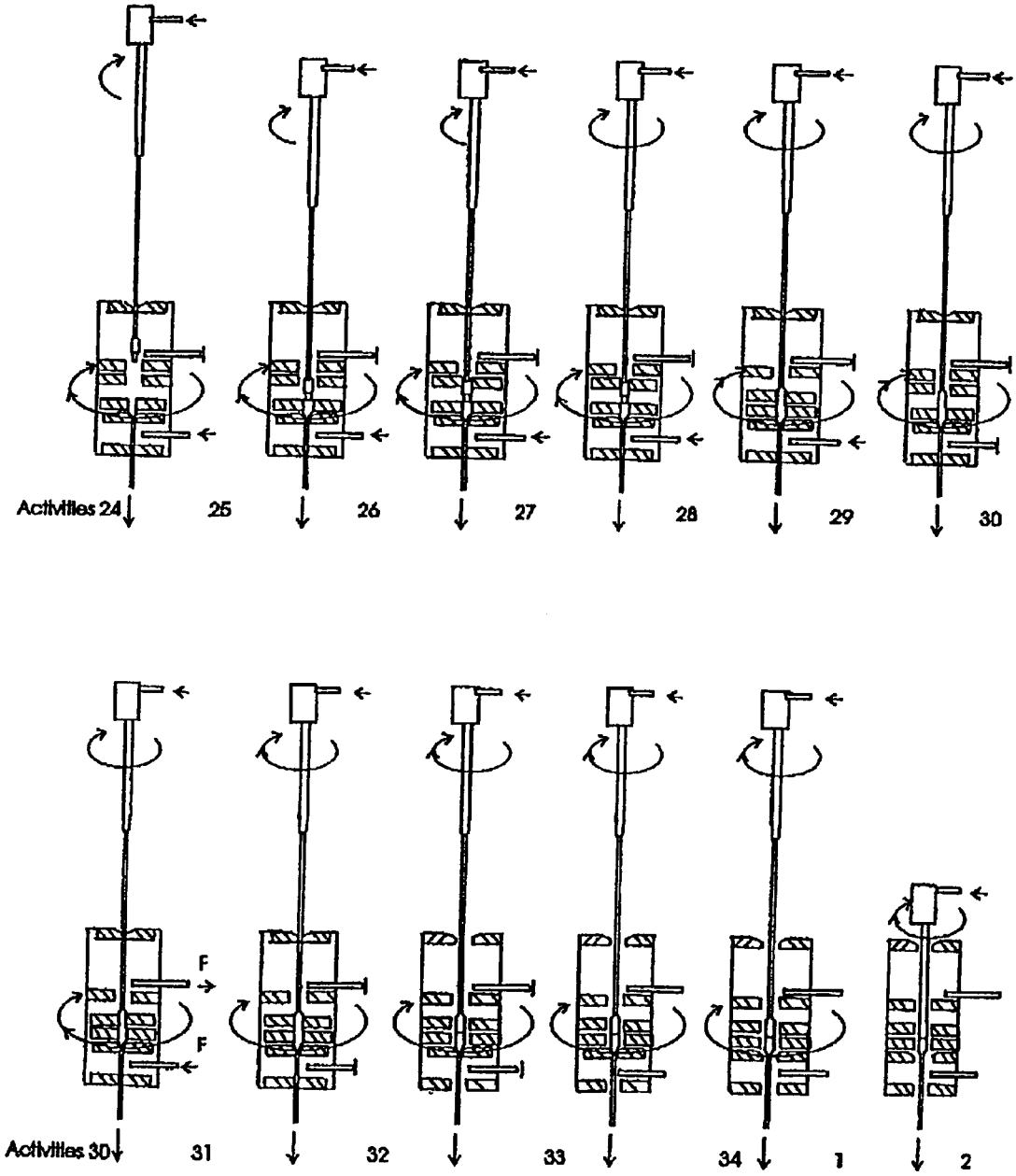

In use the sequence shown in FIGS. 4, 5, and 6 is followed in order to add a tubular to a drill string and the sequence of operations is shown in more detail in Table 1. In the Table the handlers refer to the means to move a tubular into position.

Figure 7:
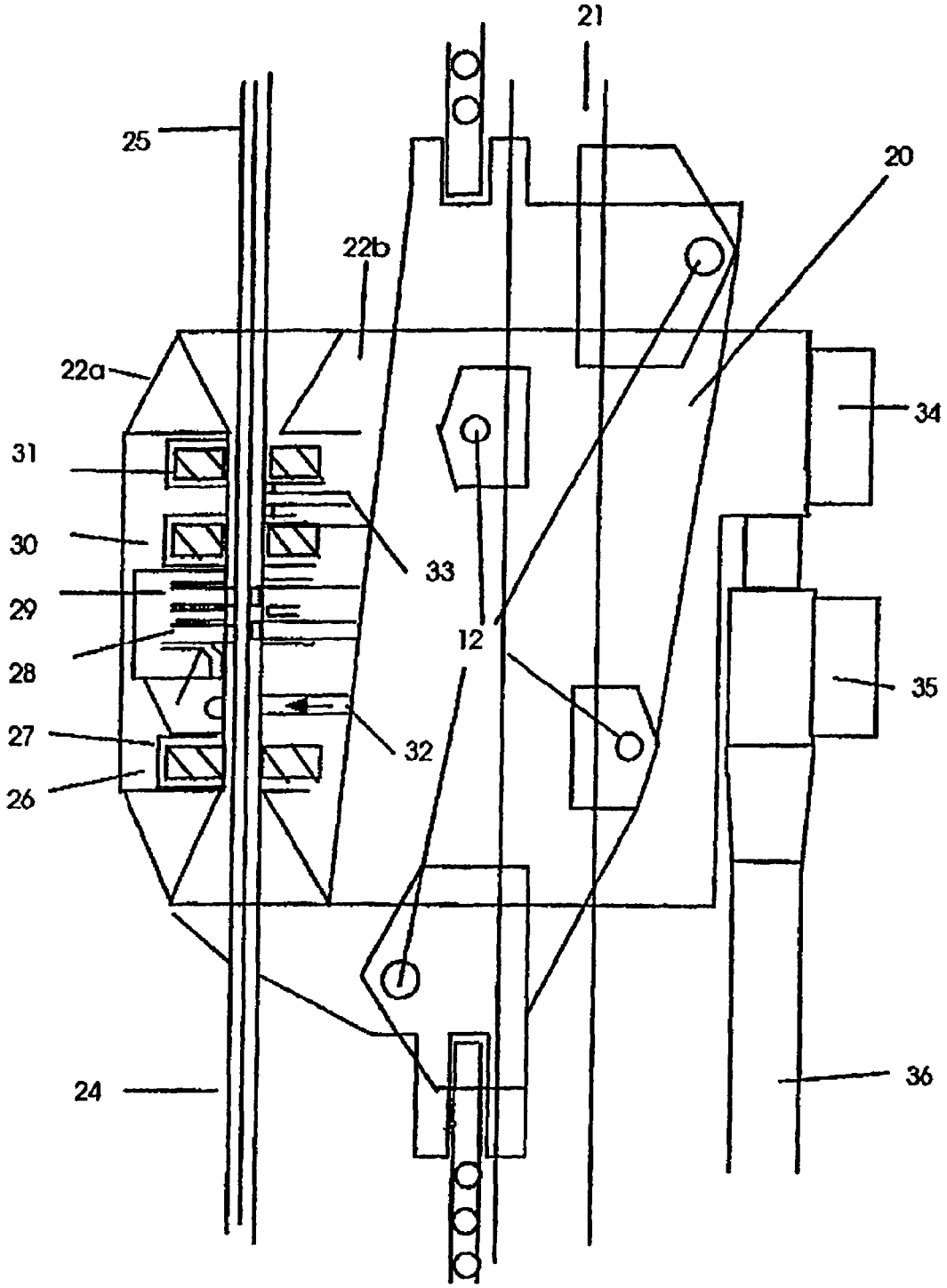
FIG. 7 shows in more detail an example of a handler used in the invention and facilitating continuous vertical motion.

Referring to FIG. 7, the handler is shown generally at (20), mounted on vertical supports (21), which can be moved horizontally, so that the handler can be moved up and down and also towards and away from the centre line of the drill string. The handler separates into two parts (22*a*) and (22*b*), in order to approach and enclose the connection between tubulars (24) and (25). The clamping section of the handler contains a lower annular preventer (26), slips (27), lower wrench (28), upper wrench (29), blind preventer (30) and upper preventer (31). Mud and other fluids can flow in through pipe (32) and out through pipe (33). The umbilicals for power, monitoring and control pass through flexible conduits at (34) (35).

In use, the handler can be positioned around the connection between tubulars (24) and (25) as they are rotating and rising upwards. The series of events are as follows:

(i) The handler moves upwards at the same speed as the drill string and the two parts (22*a*) and (22*b*) come together enclosing the connection between tubulars (24) and (25). Removing one pipe, or stand of pipes, from the drillstring achieved by running the above sequence in reverse (ii) The handler is then moved up faster until the rotating slips (27) take the weight of the drill string.

(iii) The annular preventers (26) and (21) close, the rotating wrenches (28) and (29) grip the connection upsets and the circulation fluid flushes in through (32) and temporarily out of (33).

(iv) The upper wrench (29) turns faster, or slower, than the lower wrench (28), thereby backing off tubular (24) from tubular (25) and circulation fluid from (32) now enters the drillstring.

(v) The upper wrench (29) ungrips and allows the tubular (24) to be raised up until the blind preventer (30) can close beneath it.

(vi) The contents of tubular (24) are flushed out via (36) from the other handler above.

(vii) Tubular (24) is raised clear of this handler, which continues to rise up, rotate and circulate tubular (25).

(viii) At the appropriate time, this handler ceases to take the weight of the drill string or provide rotation but continues to support tubular (25) and circulate the drill string.

(ix) This handler then raises tubular (25) a discreet distance, relative to the other handler below, before using (32) to flush out circulation fluid from tubular (25) with a fixed quantity of air, water or other fluid.

TABLE 1

Adding one pipe, or stand of pipes, to the drillstring
Activity Sequence for one cycle
FIGS. 4, 5 and 6

| Activities | 'Top Drive' | Connector | 'Handlers' |
|---|---|---|---|
| 1 | Lower drillstring to bottom stop | | |
| 2 | | Start rotation & Close slips | |
| 3 | Lower 'upset' onto slips | | |
| 4 | | Close grips and seals | |
| 5 | Rotate passively | Rotate actively | |
| 6 | | (Flush if mud being used) | |
| 7 | | Start circulation | |
| 8 | Rise passively | Break & back off joint | |
| 9 | Hold position | Release upper grip | |
| 10 | Raise to clear blind preventer | | |
| 11 | Stop circulation | Close blind preventer | |
| 12 | (Flush if mud being used) | | |
| 13 | | Open upper annular preventer | |
| 14 | Stop rotation & raise to top stop | | |
| 15 | | | Swing in new pipe |
| 16 | Lower & make up joint | | |
| 17 | | | Top releases grip |
| 18 | | | Top swings away |
| 19 | Lower pipe to blind preventer | | |
| 20 | Start Rotation | | Bottom swings away |
| 21 | | Close upper annular preventer | |
| 22 | (Flush if mud being used) | | |
| 23 | Start circulation | | |
| 24 | | Open blind preventer | |
| 25 | Lower pipe through upper grip | | |
| 26 | | Close upper grip | |
| 27 | Rotate passively | Rotate actively | |
| 28 | Lower passively | Make up joint | |
| 29 | | Stop circulation | |
| 30 | | (Flush if mud being used) | |
| 31 | Rotate actively | Rotate passively | |
| 32 | | Open both grips & both annular preventers | |
| 33 | Raise drillstring off slips | | |
| 34 | | Open slips & stop rotation | |
| 1 | Lower drillstring to bottom stop and repeat cycle | | |

(x) This handler then raises tubular (25) clear of the lower handler and transfers tubular (25) to storage, where it disengages by separating the two sections (22*a*) and (22*b*).

(xi) This handler is then lowered to below the other handler and positioned around the next connection as it comes clear of the wellhead or BOP stack and the cycle is repeated as in (i) to (xi) above.

In use the sequence set out in FIG. 4 is followed to add a tubular to a drill string and is described in the Table. The handlers refer to the means to move a tubular into position.

The method of the invention enables a steady controllable fluid pressure maintained on the exposed formation wall at all times from first drilling to the cementing of installed casing. This enables it to be much easier to hold the hole open and allows for a much easier choice of lighter muds which can greatly reduce drilling costs. Previously mud circulation had to be stopped each time a jointed drill string joint is made or broken and this prevented continuous mud circulation and inevitably meant that there were significant surges in downhole pressure. In addition mud weights were calculated on the basis of providing a specific static head pressure which is no longer required in the method of the invention.

What is claimed is:

1. A coupler for adding or removing tubulars to and from a drill string while continuing to flow drilling fluid down the drill string comprising:

(a) casing means for defining a chamber;

(b) valve means for dividing said chamber into upper and lower portions and for placing said upper and lower portions in fluid communication when said valve is open;

(c) inlet and outlet means for flowing drilling fluid into and out of said chamber;

(d) first gripping means for gripping said tubulars;

(e) second gripping means for gripping said drill string; and (f) said first and second gripping means being radially movable into and out of engagement with said tubulars and said drill string, respectively.

2. A system for connecting and disconnecting a tubular to and from a drill string comprising:

(a) a coupler comprising a high pressure casing, a divider valve dividing the coupler into upper and lower chambers, and including means for rotating a tubular and or the drill string into and out of threaded connection;

(b) a pair of handlers each having first and second portions for gripping and releasing a tubular before and after said tubular is connected to said drill string; and (c) paver means for moving said first and second handlers vertically upwardly and downwardly relative to the vertical position of the other in a hand over hand motion.

3. The system of claim 2 wherein each of said handlers include flexible umbilical means for supplying power to said handlers.

4. A coupler f or connecting and disconnecting tubulars to and from a drill string while continuously recirculating drilling fluid through the drill string, the coupler comprising:

(a) chamber means for defining a pressure chamber;

(b) partition means for dividing said chamber into upper and lower portions.

(c) said partition means including valve means for placing said upper and lower portions in communication when said valve means are open;

(d) inlet and outlet means for continuously recirculating drilling fluid into and out of said chamber;

(e) first gripping means for gripping said tubulars;

(f) second gripping means for gripping said drill string; and (g) said upper and lower gripping means being radially movable into and out of engagement with said tubulars and said string, respectively, for connecting and disconnecting said tubulars while drilling fluid is continuously circulated into and out of said chamber.

5. The coupler of claim 4 wherein at least one of said upper and lower gripping means are positioned within said chamber.

6. The coupler of claim 4 wherein both of said upper and lower gripping means are positioned inside of said pressure chamber.

7. The coupler of claim 4 including slip means for engaging said drill string against vertical movement while permitting rotation of said drill string for continuing drilling during said connection and disconnection.

8. The coupler of claim 4 in combination with a second coupler identical to that set forth in claim 4, and in combination with first and second handler means connected to said first and second couplers, respectively, including power means for moving said couplers in relative vertical motions.

9. The coupler of claim 8 wherein said power means move said first and second hand over hand motions while said drill string continuously moves vertically.

10. The coupler of claim 4 wherein said partition means and said valve means comprise a ram preventer.

11. A system for continuously drilling a bore hole while continuously circulating drilling fluid to and from said bore hole comprising:

(a) first and second casings, each of said casings supporting means for adding and removing tubulars from a drill string while continuously circulating drilling fluid to and from said bore hole;

(b) first and second handlers connected to said first and second casings, respectively; and (c) power actuator mans for moving said handlers vertically and horizontally for alternately engaging said first and second casings with said bore hole.

12. The system of claim 11 wherein said power actuator means include means for moving said first and second casings in hand-over-hand motion.

* * * * *

UNITED STATES PATENT AND TRADEMARK OFFICE

CERTIFICATE OF CORRECTION

PATENT NO. : 7,322,418 B2
APPLICATION NO. : 10/780796
DATED : January 29, 2008
INVENTOR(S) : Laurence J. Ayling It is certified that error appears in the above-identified patent and that said Letters Patent is hereby corrected as shown below:

Title Page – add item

-- (63) Related U.S. Application Data

Continuation of application 10/010,207 filed on Nov. 13, 2001, now Pat. No. 6,739,397 which is a Continuation of 09/284,449, filed on Apr. 12, 1999, Pat. No. 6,315,051 --

Signed and Sealed this

Eleventh Day of November, 2008

JON W. DUDAS
*Director of the United States Patent and Trademark Office*